US009790697B2

(12) United States Patent
Wheatley

(10) Patent No.: US 9,790,697 B2
(45) **Date of Patent: *Oct. 17, 2017**

(54) STRUCTURE REINFORCEMENT SYSTEM AND METHOD

(71) Applicant: Fortress Stabilization Systems, Holland, MI (US)

(72) Inventor: Donald E. Wheatley, Holland, MI (US)

(73) Assignee: Fortress Stabilization Systems, Holland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/152,110

(22) Filed: May 11, 2016

(65) Prior Publication Data

US 2016/0258173 A1 Sep. 8, 2016

Related U.S. Application Data

(63) Continuation-in-part of application No. 15/052,419, filed on Feb. 24, 2016, now abandoned, which is a continuation-in-part of application No. 14/795,328, filed on Jul. 9, 2015, now Pat. No. 9,290,957, which is a continuation-in-part of application No. (Continued)

(51) Int. Cl.

| | |
|---|---|
| ***E04G 23/02*** | (2006.01) |
| ***E04C 5/07*** | (2006.01) |
| ***E02D 31/10*** | (2006.01) |
| ***E04B 1/98*** | (2006.01) |

(52) U.S. Cl.

CPC ..... *E04G 23/0222* (2013.01); *E02D 31/10* (2013.01); *E04B 1/98* (2013.01); *E04C 5/07* (2013.01); *E04G 23/0229* (2013.01); *E04G 2023/0251* (2013.01); *E04G 2023/0262* (2013.01)

(58) Field of Classification Search

CPC . E04G 23/0222; E04G 23/0229; F16B 13/00; E04C 5/073

See application file for complete search history.

(56) References Cited

U.S. PATENT DOCUMENTS

| | | | |
|---|---|---|---|
| 4,474,493 | A | 10/1984 | Welch |
| 4,581,870 | A | 4/1986 | Winkowski |
| 5,018,331 | A | 5/1991 | Forzano |

(Continued)

FOREIGN PATENT DOCUMENTS

| | | | |
|---|---|---|---|
| JP | 2008-143001 | A | 6/2008 |

OTHER PUBLICATIONS

Machine Translation of JP 2008143001 a prepared by EPO on Oct. 6, 2016 (30 pages).*

(Continued)

*Primary Examiner* — Rodney Mintz

(74) *Attorney, Agent, or Firm* — Harness, Dickey & Pierce, P.L.C.

(57) ABSTRACT

A reinforcement system includes a structural member such as a concrete wall including a pair of holes formed therein. A fiber reinforcement strip is adhered to the structural member between the pair of holes. A U-shaped bracket includes a pair of legs being secured in the pair of holes and a bridge portion that overlaps an the fiber reinforcement strip, a secondary reinforcement strip can be used to distribute forces from the bridge portion of the bracket along a length of the fiber reinforcement strip.

10 Claims, 9 Drawing Sheets

Related U.S. Application Data

14/588,166, filed on Dec. 31, 2014, now Pat. No. 9,290,956.

(56) References Cited

U.S. PATENT DOCUMENTS 5,649,398 A 7/1997 Isley, Jr. et al.
5,657,595 A 8/1997 Fyfe et al.
5,987,835 A 11/1999 Santarossa
6,145,260 A 11/2000 Morton
6,247,283 B1 * 6/2001 Slabaugh ..... E04F 21/02 52/514
6,330,776 B1 12/2001 Jinno et al.
6,389,775 B1 5/2002 Steiner et al.
6,418,684 B1 7/2002 Morton
6,571,524 B2 6/2003 Pantelides et al.
6,656,299 B1 * 12/2003 Grosskrueger ..... B29C 73/02 156/293
6,692,595 B2 2/2004 Wheatley et al.
6,746,741 B2 6/2004 Wheatley
6,846,537 B2 1/2005 Wheatley et al.
6,851,232 B1 2/2005 Schwegler
7,743,585 B2 6/2010 Wheatley
7,799,154 B2 9/2010 Wu
7,823,354 B2 11/2010 Wheatley
8,142,102 B2 3/2012 Wheatley
8,201,380 B2 6/2012 Hargest et al.
8,367,569 B2 2/2013 Wheatley
8,578,670 B2 11/2013 Wu et al.
8,584,431 B2 11/2013 Secrest
8,776,474 B2 7/2014 Wu et al.
8,925,268 B2 1/2015 Tourneur et al.
8,991,132 B2 3/2015 Jung
9,010,047 B2 4/2015 Wu et al.
9,034,775 B2 5/2015 Wheatley
9,085,898 B2 7/2015 Arnold
9,194,140 B2 11/2015 Hemphill
9,290,956 B1 * 3/2016 Wheatley ..... E04G 23/024 52/514.5
9,290,957 B1 * 3/2016 Wheatley ..... E04C 5/07 52/514.5
9,322,172 B2 * 4/2016 Wu ..... E04G 23/0218 428/172
2001/0047844 A1 12/2001 Edwards et al.
2001/0049399 A1 12/2001 Edwards et al.
2002/0033000 A1 3/2002 Pantelides et al.
2003/0099525 A1 5/2003 Michels
2005/0100399 A1 5/2005 Welch
2005/0102815 A1 * 5/2005 Larsen ..... B29C 70/025 29/458
2005/0241260 A1 11/2005 Wheatley
2006/0059827 A1 3/2006 Wheatley
2007/0272353 A1 11/2007 Wheatley et al.
2008/0000571 A1 1/2008 Wu
2009/0071085 A1 3/2009 Wheatley et al.
2010/0319289 A1 12/2010 Hargest et al.
2011/0219710 A1 9/2011 Fyfe
2012/0056051 A1 3/2012 Gold
2012/0110940 A1 5/2012 Hemphill
2012/0180412 A1 7/2012 Secrest
2013/0008111 A1 1/2013 Wu et al.
2013/0008120 A1 1/2013 Wu et al.
2013/0167755 A1 7/2013 Jung
2013/0183497 A1 * 7/2013 Wu ..... E04G 23/0218 428/172
2013/0199715 A1 8/2013 Fyfe et al.
2013/0316104 A1 11/2013 Adam
2014/0245695 A1 9/2014 Arnold
2015/0068154 A1 * 3/2015 Merlob ..... E04G 23/0218 52/741.1
2016/0186453 A1 * 6/2016 Wheatley ..... E04G 23/0222 52/514.5

OTHER PUBLICATIONS

Middle East Technical University; "Anchorage Strength of Fiber Reinforced Polymers"; Thesis by Umit Serdar Camli; Nov. 2005 (97 pages).
APFIS 2009; "FRP Anchors: Recent Advances in Research and Understanding"; S.T. Smith; Dec. 2009 (10 pages).
APFIS 2012; "FRP Anchorage Systems for Infill Masonry Structures"; Lunn et al; Feb. 2012 (8 pages).
University of Massachusetts—Amherst; "Anchorage of Carbon Fiber Reinforced Polymers to Reinforced Concrete in Shear Applications"; Thesis by Carl W. Niemitz; Feb. 2008 (335 pages).
University of Waterloo; "Effect of FRP Anchors on the FRP Rehabilitation of Shear Critical RC Beams and Flexure critical RC Slabs"; Thesis by Daniel Frank Baggio; 2013 (293 pages).

* cited by examiner

STRUCTURE REINFORCEMENT SYSTEM AND METHOD

CROSS-REFERENCE TO RELATED APPLICATIONS

This application is a continuation-in-part of U.S. patent application Ser. No. 15/052,419, filed Feb. 24, 2016 (now Abandoned), which is a continuation-in-part of U.S. patent application Ser. No. 14/795,328, filed Jul. 9, 2015 (now U.S. Pat. No. 9,290,957), which is a continuation-in-part of U.S. patent application Ser. No. 14/588,166, filed Dec. 31, 2014 (now U.S. Pat. No. 9,290,956). The entire disclosures of the above applications are incorporated herein by reference.

FIELD

The present disclosure relates to a system and method for reinforcing structural elements. In particular, the present disclosure relates to a system and method for structural member reinforcement including an anchor system for anchoring a reinforcement material to a concrete, masonry, or timber wall or other structural member, such as a column, beam, floor, or ceiling.

BACKGROUND

The statements in this section merely provide background information related to the present disclosure and may not constitute prior art.

A variety of walls and other structural elements are known to be generally capable of supporting residential and light commercial structures. Over time, however, such walls and structural elements can crack, tilt, bow, or otherwise deform due to inherent weaknesses attributable to particular structural characteristics thereof.

For example, walls constructed of concrete blocks have excellent compressive strength to support structures placed upon them. However, these walls are inherently weak with respect to lateral loads and are particularly susceptible to cracking from water pressure, as the mortar joints at which these walls are connected are weak in tension and tend to separate relatively easily when subjected to tensile forces.

Deformation, such as cracking, tilting, and bowing, if left untreated, can become progressively greater and eventually facilitate collapse of an entire structural element with resultant damage to the structure supported thereon. While several methods are known for treating such deformation (e.g., it is known to adhere a carbon fiber material to a structural element, such as described in U.S. Pat. Nos. 6,692,595; 6,746,741; and 6,846,537), it would be desirable for a relatively simple and cost effective system and method for anchoring a fiber reinforcement material to a wall structure in order to treat, prevent, or otherwise inhibit deformation of the structural element.

SUMMARY

This section provides a general summary of the disclosure, and is not a comprehensive disclosure of its full scope or all of its features.

The present disclosure provides a reinforcement system for a structural element, such as a wall, column, beam, floor, or ceiling. The reinforcement system includes a concrete, masonry, or timber structural member, including a pair of holes formed therein. A fiber reinforcement strip is adhered to the structural member between the pair of holes. A bracket includes a pair of legs being secured within the pair of holes and a bridge portion that overlaps the fiber reinforcement strip. The first end of the fiber reinforcement strip can be wrapped or rolled successively around the bridge portion, such that it is rolled upon itself and/or adhered to an intermediate portion of the fiber reinforcement strip.

According to a further aspect of the present disclosure, the U-shaped bracket can also include a widened bridge portion in order to increase the surface area for adhering the U-shaped bracket to the fiber reinforcement strip and the structural member.

According to a further aspect of the present disclosure, the bridge portion can include an arcuate edge to permit the fiber reinforcement strip to be smoothly wrapped around the bridge portion. In some embodiments, an opposing tapered edge extending along an opposing side relative to the arcuate edge can be used to permit the first end of the fiber reinforcement strip to be smoothly adhered to the intermediate portion of the fiber reinforcement strip. In some embodiments, the arcuate edge can extend circumferentially about the bridge portion to form a cylindrical cross-section to permit the fiber reinforcement strip to be rolled about the bridge portion, thereby capturing the first end in a rolled fashion.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 3A:
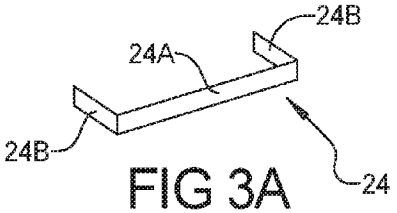
Figure 3B:
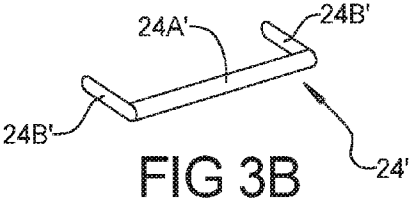
Figure 3C:
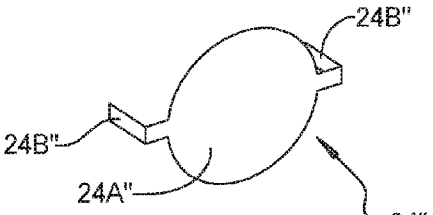
Figure 3D:
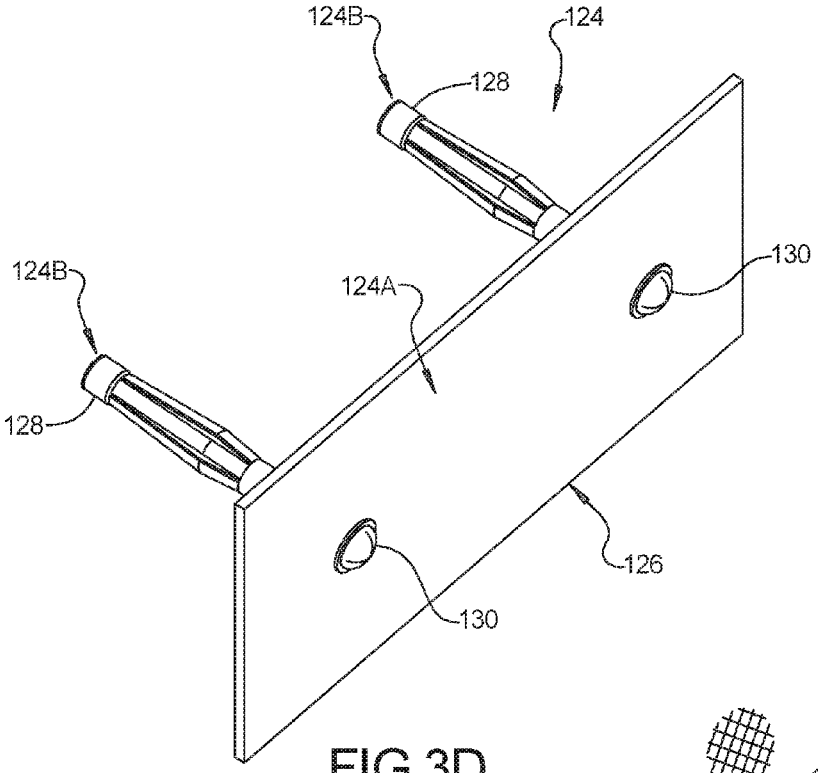
Figure 3E:
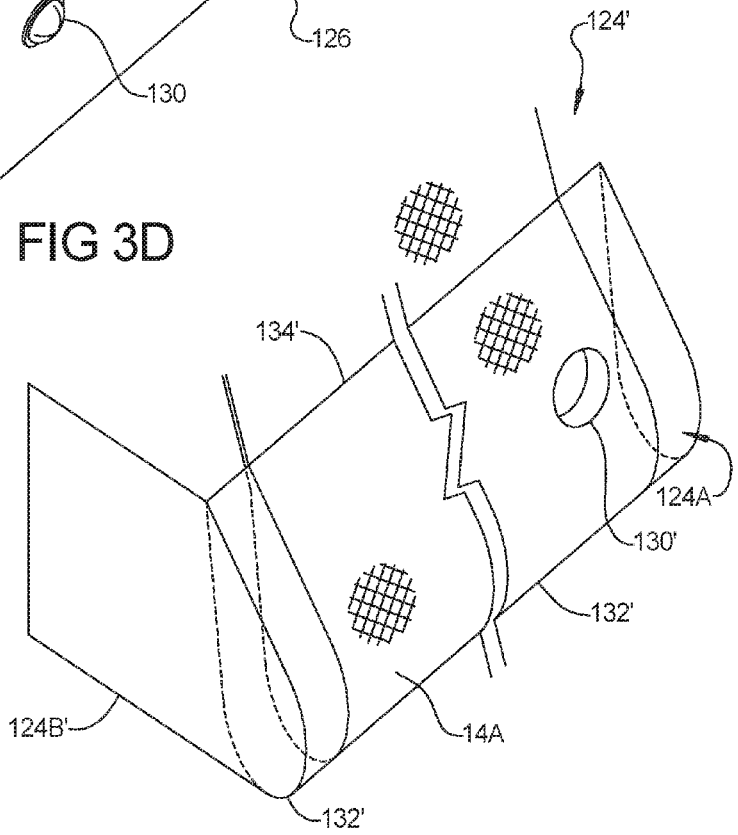
Figure 4:
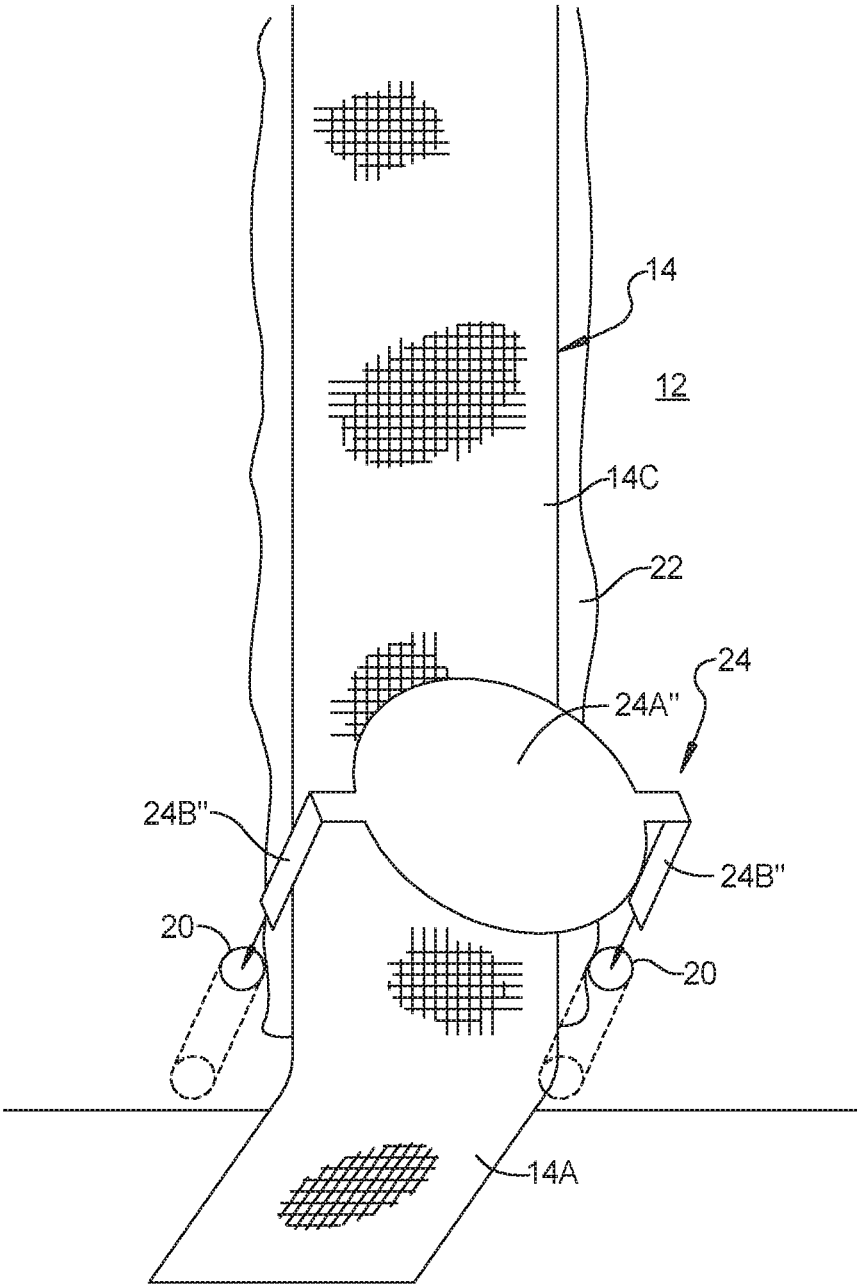
Figure 5A:
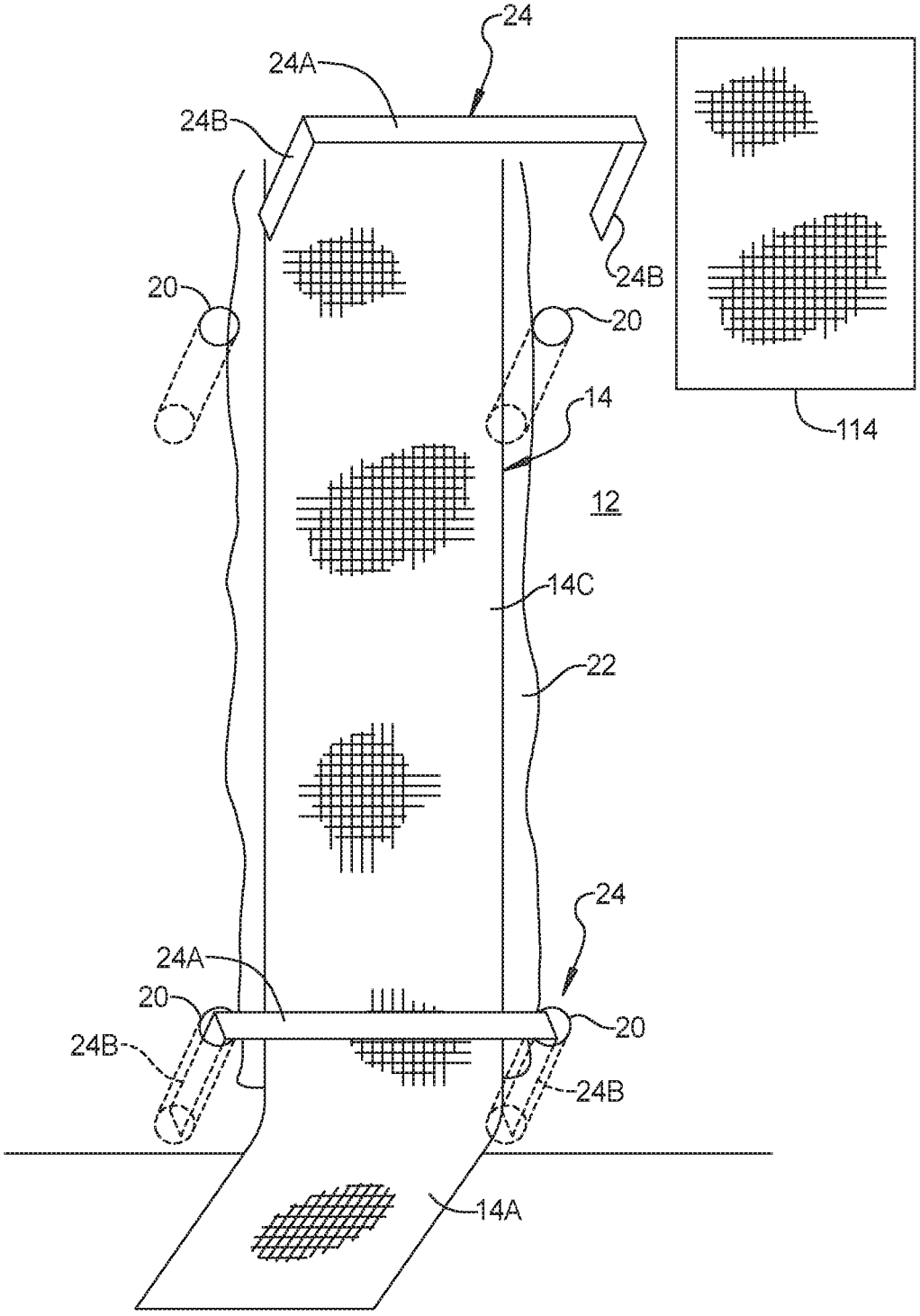
Figure 5B:
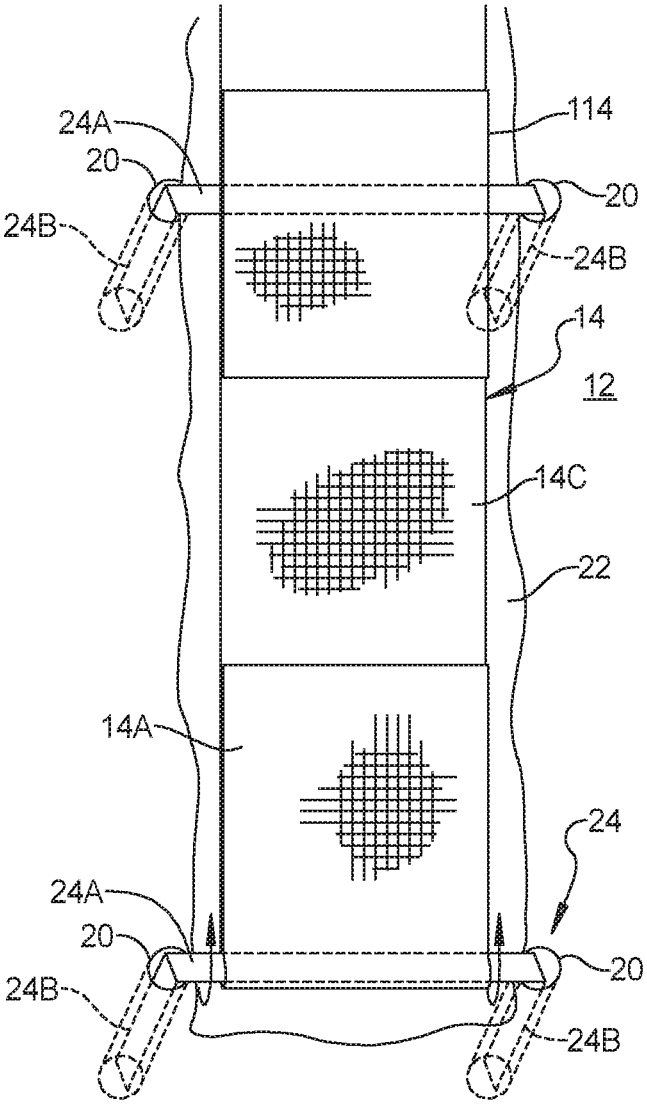
Figure 5D:
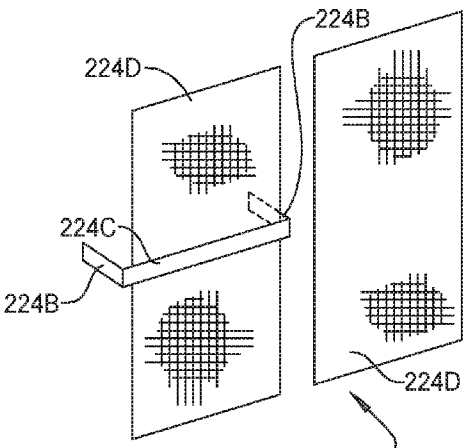
Figure 5E:
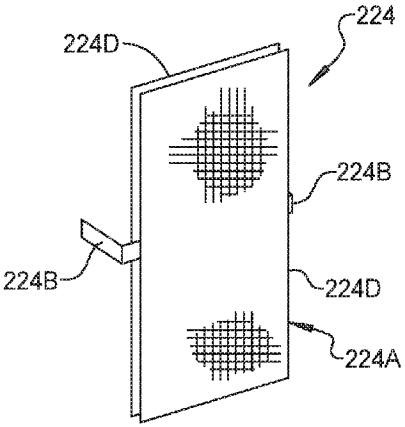
Figure 5C:
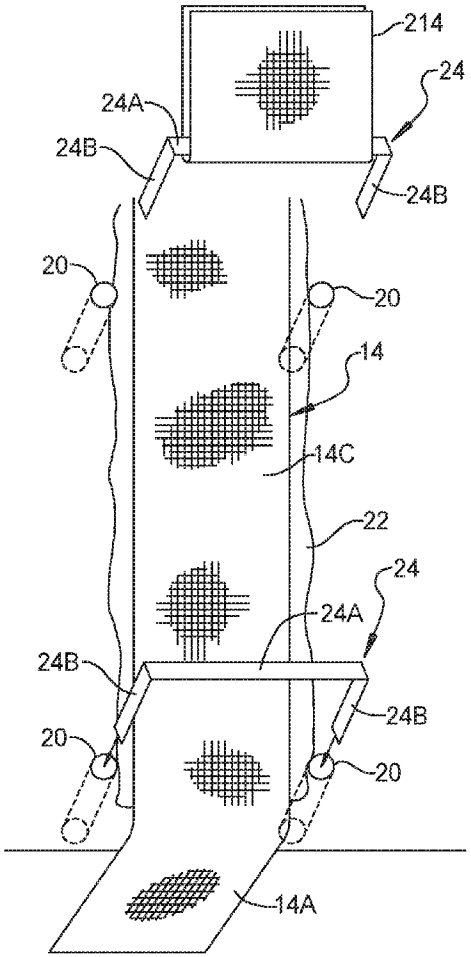

FIGS. 3A, 3B, 3C, 3D, and 3E illustrate exemplary brackets used for anchoring the fiber reinforcement material to the wall structure; and FIG. 4 illustrates a bracket having a widened bridge portion for anchoring a fiber reinforcement strip to a wall structure according to a further aspect of the present disclosure;

FIGS. 5A and 5B illustrate exemplary steps for installing a reinforcement system and for a reinforcement method according to the principles of the present disclosure;

FIG. 5C is illustrate steps for installing an alternative reinforcement system and for a reinforcement method according to the principles of the present disclosure; and FIGS. 5D, 5E illustrate the components of an exemplary bracket assembly having an enlarged bridge portion for anchoring a fiber reinforcement strip to a wall structure according to a further aspect of the present disclosure.

Corresponding reference numerals indicate corresponding parts throughout the several views of the drawings.

DETAILED DESCRIPTION

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1:
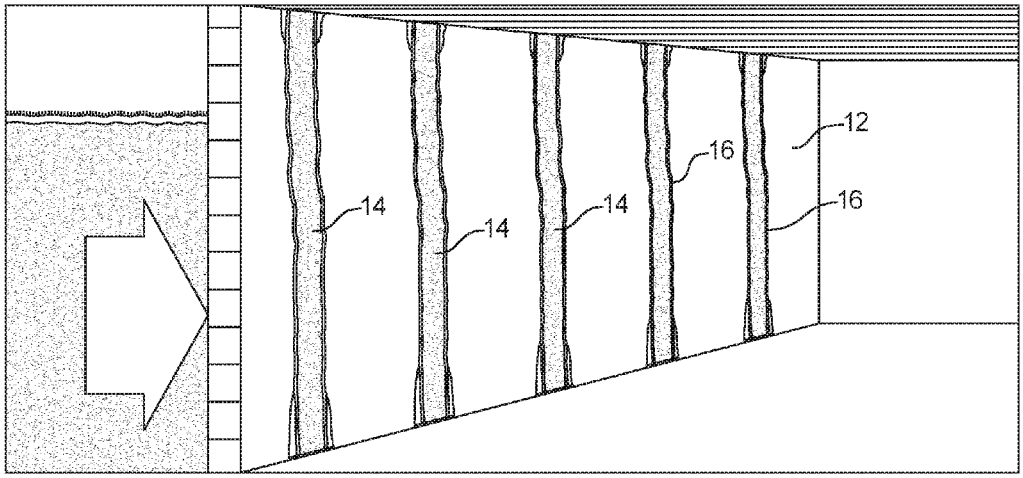
FIG. 1 illustrates an exemplary wall for use with a reinforcement system and method according to the principles of the present disclosure.

Referring to FIG. 1 reinforcement system 10 can be utilized with a structural member or structure 12 that can include a block wall, brick wall, a poured concrete wall, a timber wall, a concrete pillar, beam, ceiling, floor, or other concrete structure. Reinforcement system 10 can be installed as fiber reinforcement strips 14 that can be adhered to the structural member 12. FIG. 1 illustrates exemplary installation locations 16 for reinforcement system 10 relative to wall structure 12. It should be understood that the installation locations 16 can vary depending upon the direction in which reinforcement is required. Therefore, the fiber reinforcement strips 14 can extend vertically (as shown) or alternatively horizontally or diagonally as desired. In some embodiments, the reinforcement can be wrapped around the pillar or other structure.

Figure 2A:
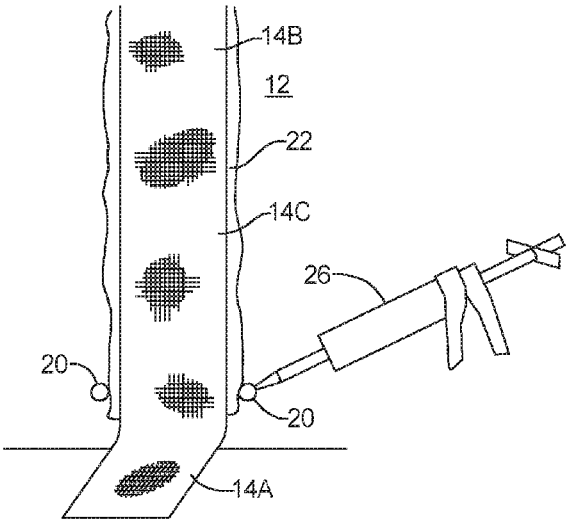
FIGS. 2A, 2B, 2C, 2D and 2E illustrate exemplary steps for installing a reinforcement system and for a reinforcement method according to the principles of the present disclosure.
Figure 2B:
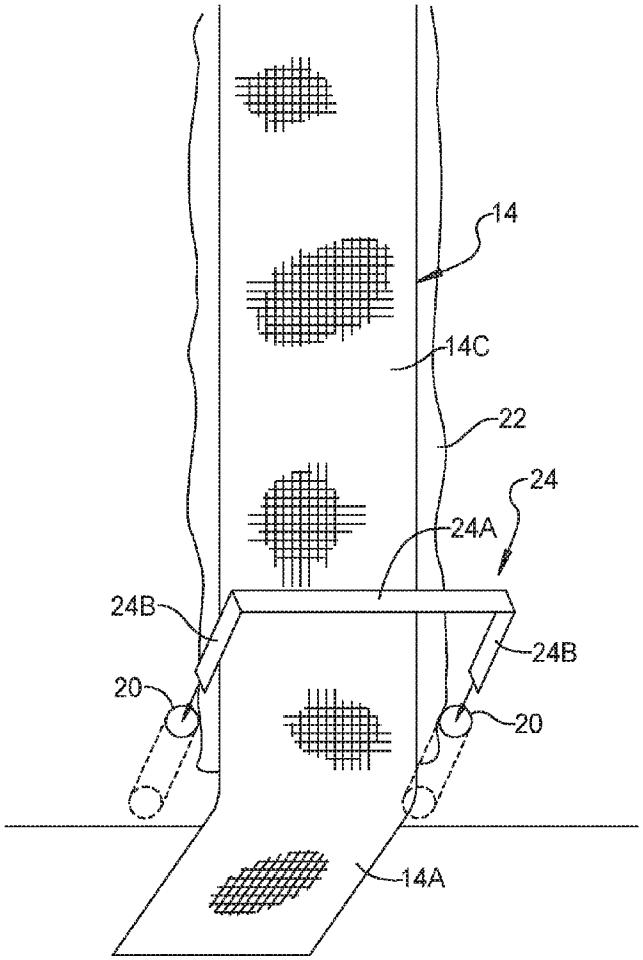
Figure 2C:
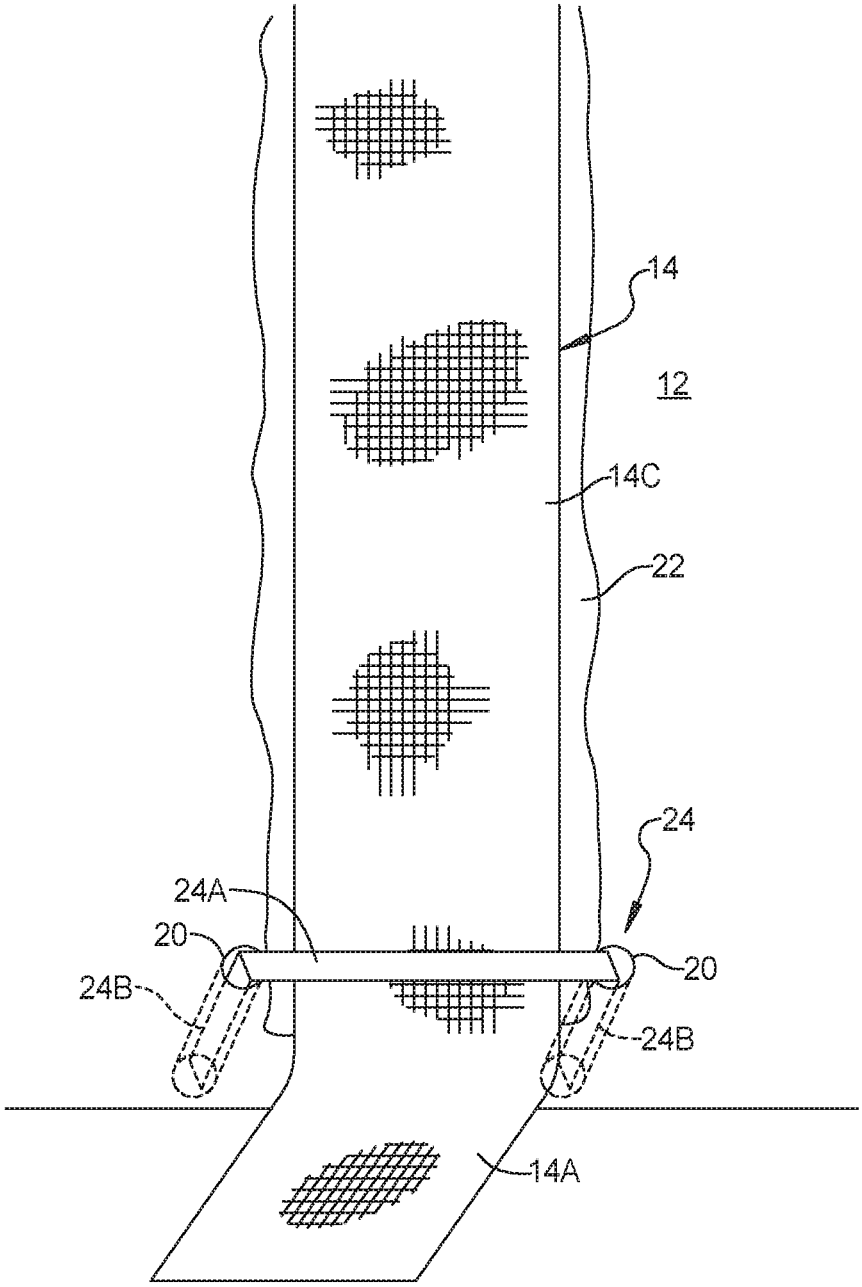
Figure 2D:
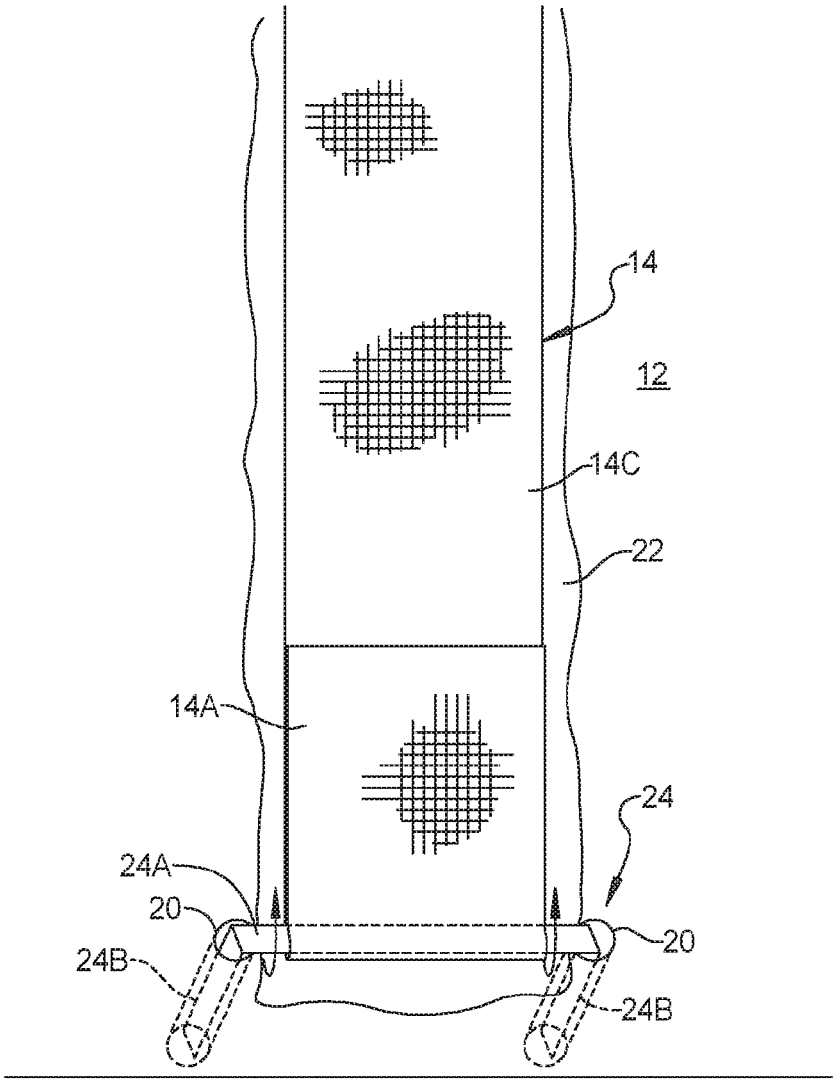
Figure 2E:
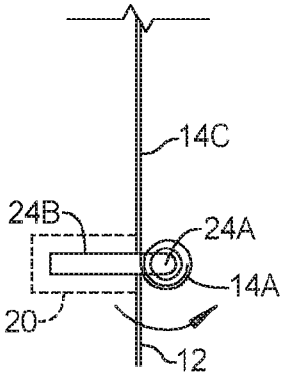

With particular reference to FIGS. 2A-2E, exemplary steps for installing reinforcement system 10 and for a reinforcement method according to the present disclosure are illustrated. Referring to FIG. 2A, a pair of holes 20 are formed in the structural member 12. The pair of holes 20 can be formed at a base of a wall, top of the wall, or at another location on a structural member 12. The fiber reinforcement strip 14 is adhered to the structural member 12 between the pair of holes 20 by an adhesive 22. The fiber reinforcement strip includes a first end 14A, a second end 14B, and an intermediate portion 14C disposed between the first and second ends 14A, 14B. Adhesive is injected into the pair of holes 20 via a caulking gun 26 (FIG. 2A) or other device. As shown in FIG. 2B, a bracket 24 is provided including a bridge portion 24A and a pair of end legs 24B disposed at opposite ends of the bridge portion 24A. As shown in FIG. 2C, the pair of end legs 24B of the bracket 24 are inserted into the pair of holes 20. As shown in FIG. 2D, the first end 14A of the fiber reinforcement strip 14 can then be folded around the bridge portion 24A of the bracket 24 and can be adhered to the intermediate portion 14C of the fiber reinforcement strip 14. As shown in FIG. 2E, the first end 14A of the fiber reinforcement strip 14 can alternatively be rolled about bridge portion 24A so as to capture first end 14A upon itself. As will be discussed herein, bridge portion 24A can define alternative cross-sectional profiles (e.g. flat, arcuate, tapers, cylindrical, or other shape) to aid in the assembly and/or installation of fiber reinforcement strip 14. The second end 14B of the fiber reinforcement strip 14 can be anchored to the structural member 12 in a similar way or can alternatively be mounted to other structures such as a sill plate by a bracket or other techniques.

The fiber reinforcement strips 14 can include a number of longitudinal fiber bundles and a plurality of transverse fiber bundles that can be woven together or otherwise layered to form a flexible reinforcement strip. The fibers can include carbon fibers or other fibers such as Kevlar, nylon, or other synthetic or natural fibers that exhibit strong tensile strength.

As shown in FIG. 3A, the brackets 24 can be formed from a number of longitudinal fiber bundles and a plurality of transverse fiber bundles that can be woven together or otherwise layered to form a bracket. The fibers can include carbon fibers or other fibers such as Kevlar, nylon or other synthetic or natural fibers that exhibit strong tensile strength. The reinforcement strip can be coated with an epoxy or adhesive and allowed to cure in the U-shape configuration having a bridge portion 24A and a pair of legs 24B, as disclosed in the commonly assigned U.S. Pat. No. 7,823,354. Alternatively, the brackets 24' can be made from metal or other materials that can be formed in the U-shape configuration as disclosed, as shown in FIG. 3B. Moreover, it should be understood that bracket 24' can be made by casting, forging, injection molding, or other methods known to produce robust structural members.

As illustrated particularly in FIGS. 3A-3D, it is shown that brackets 24, 24', and 24" can be flat, cylindrical, or can define other predetermined shapes. In particular, in some embodiments, brackets 24, 24', and 24" can define a generally flat cross-sectional profile in bridge portion 24A, 24A', and 24A" and/or in legs 24B, 24B', and 24B". Similarly, in some embodiments, brackets 24, 24', 24" can define a cylindrical cross-sectional profile in bridge portion 24A, 24A', and 24" and/or in legs 24B, 24B', and 24B".

As shown in FIG. 3D, the brackets 124 can be made from a plate 126 defining a bridge portion 124A and a pair of molly fasteners or other anchors 128 inserted through a pair of apertures 130 in the plate 126 and defining a pair of legs 124B. The plate 124A can be made from steel, other metals or other materials, such as plastic or other fiber reinforced material. If molly fasteners are used, the molly fasteners can be inserted into the holes 20 in the structural member 12 and mechanically expanded to secure the fasteners within the holes 20. Molly fasteners generally include a sleeve that receives a screw which when screwed into the sleeve causes the sleeve to expand outward and spread to trap the expanded sleeve within the hole 20. If other anchors 128 are used, the anchors can be inserted into the holes 20 and secured therein with an adhesive. For reinforcing a block wall, it is preferred that the brackets 24/124 are secured to the lowest course of blocks which are typically partially covered by a concrete floor that secures the blocks from being pulled inward.

As shown in FIG. 3E, the bracket 124' can define a bridge portion 124A' and a pair of legs 124B'. The pair of legs 124B' can be integrally formed with bridge portion 124A' (as similarly configured in FIGS. 3A-3C) and/or include molly fasteners or other anchors 128 (see FIG. 3D) inserted through a pair of apertures 130' in bridge portion 124A'. The bridge portion plate 124A' can comprise a cross-sectional shape having an arcuate edge 132'. In some embodiments, bridge portion plate 124A' can further comprise an opposing tapered edge 134'. Arcuate edge 132' can extend along the edge of bridge portion plate 124A' such that first end 14A of the fiber reinforcement strip 14 can then be folded about arcuate edge 132' thereby extending around the bridge portion 124A' of the bracket 124'. As described herein, the first end 14A of the fiber reinforcement strip 14 can be rolled upon itself about bridge portion plate 124A' (particularly, if arcuate edge 132' extends about bridge portion plate 124A' to define a cylinder. In some embodiments, the first end 14A of the fiber reinforcement strip 14 can be adhered to the intermediate portion 14C of the fiber reinforcement strip 14 by lying along tapered edge 134'. In this way, first end 14A of fiber reinforcement strip 14 can smoothly extend about arcuate edge 132' and then smoothly transition along tapered edge 134' to a nested adhered arrangement with intermediate portion 14C. Moreover, it should be appreciated that tapered edge 134' permits first end 14A of fiber reinforcement strip 14 to smoothly transition from bridge portion 124A' to contact with intermediate portion 14C without a substantial gap there between. This permits a more seamless connecting interface between first end 14A and intermediate portion 14C, thereby maximizing the contact surface area there between.

It should be appreciated that brackets 124' can comprise any number of particular cross-sectional shapes providing an arcuate edge and/or a tapered transition of fiber reinforcement strip 14. In some embodiments, as shown in FIG. 3E, bracket 124' can comprise an arcuate edge 132' that immediately transitions into tapered edge 134'. However, it should be understood that additional and/or alternative transitions between arcuate edge 132' and tapered edge 134' are anticipated, such as an intermediate plane or other feature.

The bracket 124' can be made from steel, other metals, and/or other materials, such as plastics or fiber reinforced material, or a combination thereof. If molly fasteners are used, the molly fasteners can be inserted into the holes 20 in the structural member 12 and mechanically expanded to secure the fasteners within the holes 20. If other anchors 128' are used, the anchors can be inserted into the holes 20 and secured therein with an adhesive. For reinforcing a block wall, it is preferred that the brackets 24, 24', 24", 124, 124' are secured to the lowest course of blocks which are typically partially covered by a concrete floor that secures the blocks from being pulled inward.

With reference to FIG. 3C, the brackets 24" can be provided with a widened bridge portion 24A". By "widened bridge portion" it is meant that the bridge portion 24A" has a width that is wider than a width of the legs 24B". The widened bridge portion 24A" can be formed in various ways including being formed integrally with the pair of legs 24B" or can alternatively be formed separately from and then adhered to a bracket 24. The widened bridge portion 24A" can have various shapes, including circular, oval, rectangular, square or other desired shapes. The brackets 24" can be formed from a number of longitudinal fiber bundles and a plurality of transverse fiber bundles that can be woven together or otherwise layered to form a flexible reinforcement strip. The fibers can include carbon fibers or other fibers such as Kevlar, nylon or other synthetic or natural fibers that exhibit strong tensile strength. The reinforcement strip can be coated with an epoxy or adhesive and allowed to cure in the U-shape configuration 24". Alternatively, the brackets 24" can be made from metal or other materials that can be formed in the U-shape configuration as disclosed.

The brackets 24, 24', 24", 124, 124' can also be mounted at an intermediate location along a fiber reinforcement strip 14 to secure the fiber reinforcement strip 14 to a structural member. In particular, as shown in FIG. 4, a U-shaped bracket 24" having a widened bridge portion 24A" is shown with the legs 24B" adhered in a pair of holes 20 and with the widened bridge portion 24A" overlapping the fiber reinforcement strip 14.

The pair of holes 20 that are formed in the structural member 12 can be formed by drilling, cutting or other techniques. Mesh screens or other containment devices can be inserted into the pair of holes 20 in order to contain the adhesive that is injected therein while the adhesive cures.

With reference to FIGS. 5A and 5B, the fiber reinforcement strip 14 can be secured to the structural member 12 along the intermediate portion 14C by forming a pair of holes 20 at an intermediate location along the structural member 12. The fiber reinforcement strip 14 is adhered to the structural member 12 between the pair of holes 20 by an adhesive 22. A bracket 24 having a bridge portion 24A and a pair of legs 24B is provided for anchoring the intermediate portion 14C of the fiber reinforcement strip 14 to the structural member 12. In addition, a secondary fiber reinforcement strip 114 is provided for sandwiching the bridge portion 24A of the bracket 24 between the secondary reinforcement strip 114 and the fiber reinforcement strip 14. The secondary fiber reinforcement strip 114 is adhered to the bridge portion 24A and to the fiber reinforcement strip 14 in order to distribute the forces that are applied to the bracket 24 along a length of the intermediate portion 14C of the fiber reinforcement strip 14. As shown in FIG. 5B, the pair of legs 24B of the bracket 24 are secured in the pair of holes 20 on opposite sides of the reinforcement strip 14. The pair of legs 24B can be secured within the holes 20 by an adhesive, or can be in the form of a Molly fastener as disclosed herein. The secondary reinforcement strip 114 is then adhered to the intermediate portion 14C of the reinforcement strip 14 over top of the bridge portion 24A of the bracket 24 as illustrated in FIG. 5B.

With reference to FIG. 5C, the fiber reinforcement strip 14 can be secured to the structural member 12. The intermediate portion 14C of the fiber reinforcement strip 14 can be anchored to the structural member 14 by forming a pair of holes 20 at an intermediate location along the structural member 12. The fiber reinforcement strip 14 is adhered to the structural member 12 between the pair of holes 20 by an adhesive 22. A bracket 24 having a bridge portion 24A and a pair of legs 24B is provided for anchoring the intermediate portion 14C of the fiber reinforcement strip 14 to the structural member 12. In addition, a secondary fiber reinforcement strip 214 is wrapped such as being folded or rolled fully or partially around the bridge portion 24A of the bracket 24. The pair of legs 24B of the bracket 24 are secured in the holes 20 of the structural member 12 and the folded fiber reinforcement strip 214 is adhered to the intermediate portion 14C of the fiber reinforcement strip 14 in order to distribute the forces that are applied to the bracket 24 along a length of the fiber reinforcement strip 14.

According to an alternative embodiment as shown in FIGS. 5D and 5E, a bracket assembly 224 is formed with a pair of legs 224B and an enlarged bridge portion 224A that can include a first bridge member 224C extending between the pair of legs 224B. At least one secondary fiber reinforcement strip 224D is adhered to the first bridge member 224C to provide the enlarged bridge portion 224A. According to a preferred embodiment, the enlarged bridge portion 224A can be comprised of a pair of secondary fiber reinforcement strips 224D that are adhered to one another and sandwich the first bridge member 224C there between. The bracket 224 is secured to the structural member 12 by securing the pair of legs 224B in a pair of holes 20 in the structural member 12 on opposite sides of a reinforcement strip 14 and the enlarged bridge portion 224A can be adhered to the intermediate portion 14C of the reinforcement strip 14 in order to distribute the forces that are applied to the bracket 124 along a length of the fiber reinforcement strip 14. It is further noted that the brackets 124 (shown in FIG. 3D), 124' (shown in FIG. 3E), and the bracket 24 with the enlarged bridge portion 24A" (shown in FIGS. 3C, 4) can each be utilized with widened bridge portions for anchoring the intermediate portion of the fiber reinforcement strip 14 to the structural member 12.

The present disclosure can vary in many ways. For example, a reinforcement system according to the principles of the present disclosure can have a variety of components which each can have a variety of configurations and can be made of a variety of materials. Furthermore, the installation steps for a reinforcement system according to the principles of the present disclosure and reinforcement methods according to the principles of the present disclosure can vary. Additionally, a reinforcement system and method according to the principles of the present disclosure can be used in a variety of applications. As such, it should be understood that the present disclosure is exemplary in nature.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of reinforcing a structure, comprising the steps of:

forming a pair of holes in the structure;

adhering a first fiber reinforcement strip to the structure between the pair of holes;

providing a bracket having a bridge portion and a pair of legs extending from opposite ends of the bridge portion, wherein the bridge portion and the pair of legs of the bracket are integrally formed as a unitary member from a second fiber reinforcement strip;

wrapping a third fiber reinforcement strip at least partially around the bridge portion of the bracket;

securing the pair of legs into the pair of holes with the bridge portion overlapping the first fiber reinforcement strip; and adhering the third fiber reinforcement strip to the first fiber reinforcement strip.

2. The method according to claim 1, wherein the first, second and third fiber reinforcement strips are made from carbon fibers.

3. The method according to claim 1, wherein said pair of legs are secured in the holes by an adhesive that is injected into the holes.

4. The method according to claim 1, wherein the pair of holes include a pair of elongated slots.

5. A method of reinforcing a structure, comprising the steps of:

forming a pair of holes in the structure;

adhering a first fiber reinforcement strip to the structure between the pair of holes;

providing a bracket formed from a second fiber reinforcement strip and having a bridge portion and a pair of legs integrally formed with and extending from opposite ends of the bridge portion;

securing the pair of legs into the pair of holes with the enlarged bridge portion overlapping the first fiber reinforcement strip, wherein the bridge portion includes a third fiber reinforcement strip that is adhered to the bridge portion to provide an enlarged bridge member.

6. The method according to claim 5, wherein the pair of holes include a pair of elongated slots.

7. A method of reinforcing a structure, comprising the steps of:

forming a pair of holes in the structure;

adhering a first fiber reinforcement strip to the structure between the pair of holes;

providing a bracket having a bridge portion and a pair of legs extending from opposite ends of the bridge portion, the bridge portion being enlarged so as to have a wider width than the pair of legs;

securing the pair of legs into the pair of holes with the enlarged bridge portion overlapping the first fiber reinforcement strip, wherein the enlarged bridge portion of the bracket includes a bridge member extending between the pair of legs and a pair of layered second fiber reinforcement strips sandwiching and adhered to the bridge member.

8. The method according to claim 7, wherein the pair of holes include a pair of elongated slots.

9. A method of reinforcing a structure, comprising the steps of:

forming a pair of holes in the structure;

adhering a first fiber reinforcement strip to the structure between the pair of holes;

providing a bracket having a bridge portion and a pair of legs extending from opposite ends of the bridge portion, the bridge portion being enlarged so as to have a wider width than the pair of legs;

securing the pair of legs into the pair of holes with the enlarged bridge portion overlapping the first fiber reinforcement strip, wherein the bridge portion and the pair of legs of the bracket are integrally formed as a unitary member, wherein said pair of legs are secured in the holes by an adhesive that is injected into the holes.

10. The method according to claim 9, wherein the pair of holes include a pair of elongated slots.

* * * * *